US006860722B2

(12) United States Patent
Forrester et al.

(10) Patent No.: US 6,860,722 B2
(45) Date of Patent: Mar. 1, 2005

(54) SNAP ON BLADE SHIM

(75) Inventors: James Michael Forrester, Springboro, OH (US); Emily Anne Clausing, Cincinnati, OH (US); Robert Russell Grant, Mason, OH (US); John Gregory Cargill, West Chester, OH (US); Craig William Higgins, Hamilton, OH (US)

(73) Assignee: General Electric Company, Schenectady, NY (US)

( * ) Notice: Subject to any disclaimer, the term of this patent is extended or adjusted under 35 U.S.C. 154(b) by 212 days.

(21) Appl. No.: 10/356,238

(22) Filed: Jan. 31, 2003

(65) Prior Publication Data

US 2004/0151590 A1 Aug. 5, 2004

(51) Int. Cl.[7] ..... F01D 5/30

(52) U.S. Cl. ..... 416/219 R; 416/193 A; 416/248

(58) Field of Search ..... 416/219 A, 248, 416/193 A, 204 A, 220 R, 500, 221, 224, 229 A, 230; 415/170.1

(56) References Cited

U.S. PATENT DOCUMENTS 5,160,243 A 11/1992 Herzner et al.
5,240,375 A 8/1993 Wayte
6,290,466 B1 9/2001 Ravenhall et al.
6,398,499 B1 * 6/2002 Simonetti et al. ..... 416/193 A
6,431,835 B1 8/2002 Kolodziej et al.

* cited by examiner

*Primary Examiner*—Edward K. Look
*Assistant Examiner*—James M McAleenan
(74) *Attorney, Agent, or Firm*—William Scott Andes; Steven J. Rosen

(57) ABSTRACT

A gas turbine engine blade root shim includes a dovetail shim portion with a dovetail shape and a longitudinally extending substantially flat base and distal first and second longitudinally spaced apart forward and aft ends. Transversely spaced apart first and second walls extend upwardly from the base which includes at least two longitudinally extending elongated base apertures. Each of the base apertures includes a main region and longitudinally spaced apart rounded end regions. Dog-bone-shaped base apertures or rounded end base apertures having semi-circular rounded end regions may be used. The shim is designed for a blade dovetail root with a root slot formed in a bottom of the dovetail root. The dovetail shim portion with the dovetail shape substantially conforms to at least a portion of a cross-sectional dovetail shape of the dovetail root through the root slot. The base is disposed within the root slot.

22 Claims, 5 Drawing Sheets

SNAP ON BLADE SHIM

BACKGROUND OF THE INVENTION

1. Field of the Invention

The invention relates to aircraft gas turbine engine blades retained by dovetail roots in dove tail slots in rotor disks and, particularly, to shims disposed around the dovetail roots.

2. Description of Related Art

Many gas turbine engines retain rotor blades in disks using dovetail roots of the blades disposed in dovetail slots in the rotor. The disks and blades are often made of expensive Titanium alloys because of their good strength, low density, and favorable environmental properties at low and moderate temperatures. Sacrificial shims disposed between the disks and roots are used to reduce fretting and wear of the more expensive disks and roots.

A compressor or fan disk may have an array of dovetail slots in its outer periphery and dovetail roots of a titanium compressor or fan blade is received into each dovetail slot. At rest, the dovetail of the blade is retained within the slot. In one exemplary engine, the shim is retained axially in the disk by a forwardly located blade retainer and an aftwardly located booster spool flange. Past engine experience has shown that during operation, the fan blade shim can move axially in the slot and distress a forward face or surface of the booster spool flange. The booster spool is a critical rotating component and any distress to the surface may render it unserviceable.

When the engine is operating, centrifugal force induces the blade to move radially outwardly. The sides of the blade dovetail slide against the sloping sides of the dovetail slot of the disk, producing relative motion between the blade and the rotor disk. The sliding between the titanium blade root and disk is particularly acute during transient operating conditions such as engine start-up, power-up (takeoff), power-down and shutdown. The sliding can cause fretting of the disk and blade root and lead to a reduction in fatigue capability of the titanium parts. During such operating conditions, normal and sliding forces exerted on the rotor in the vicinity of the dovetail slot can also lead to galling, followed by the initiation and propagation of fatigue cracks in the disk. It is difficult to predict crack initiation or extent of damage as the number of engine cycles increase. Engine operators, such as the airlines, must therefore inspect the insides of the rotor dovetail slots frequently, which is a highly laborious process. Sacrificial shims have been developed to eliminate the wear, fretting, and galling of the titanium disks, rotors, and blade roots.

U.S. Pat. Nos. 5,160,243 and 5,240,375 disclose a variety of single layer and multi-layer shims designed for mounting between the root of a titanium blade and its corresponding groove in a titanium rotor. The simplest of these shims is a U-shaped shim designed to slide over the root of the fan blade, (see FIG. 3 of the '243 patent). The inventors of U.S. Pat. No. 6,431,835 found that a disadvantage to this type of shim are that it has a tendency to come lose during engine operation and also, does not entirely eliminate the fretting between the groove and the fan blade root.

U.S. Pat. No. 6,431,835 discloses a compliant shim for use between the root of a gas turbine fan blade and a dovetail groove in a gas turbine rotor disk to reduce fretting therebetween. The blade root has tabs at its leading and trailing edges that extend radially inwardly from a recessed inner surface of the root. The compliant shim has first and second slots for engaging the tabs. The slots and tabs cooperate to hold the shim during engine operation. An oxidation layer covers the compliant shim.

The blade is mounted to the disk by sliding the shim onto the root and then inserting the shimmed blade into a dovetail slot. The cross-section of such shims do not match the cross-sections of the roots and, thus, sliding the shim onto the root is difficult and can break or weaken the shim. Thus, it is desirable to have a shim that can be easily mounted onto the blade root and requires spreading apart the shim so that it can fit over the dovetail portion of the blade root and snap fit into the slot between the tabs and against the recessed inner surface of the root.

SUMMARY OF THE INVENTION

A gas turbine engine blade root shim includes a dovetail shim portion with a dovetail shape and a longitudinally extending substantially flat base and distal first and second longitudinally spaced apart forward and aft ends. Transversely spaced apart first and second walls extend upwardly from the base which includes at least two longitudinally extending elongated base apertures. Each of the base apertures includes a main region and longitudinally spaced apart rounded end regions. In an exemplary embodiment of the shim, the main region of the base apertures has substantially parallel and straight aperture sides. More particular embodiments of the base apertures include dog-bone-shaped base apertures in which the rounded end regions are wider than the main region and rounded end base apertures in which the rounded end regions are semi-circular rounded end regions having a width which is the same width as that of the main region.

In the exemplary embodiment of the shim, the first and second walls includes first and second lower portions extending upwardly from and at an angle away from the base and from each other and first and second upper portions extending upwardly from the first and second lower portions, respectively, and towards each other. The forward and aft ends of the shim include forward and aft slots at the forward and aft ends of the dovetail shim portion. Cutbacks in the first and second lower portions of the first and second walls, respectively, extend from the base at the forward and aft slots to forward and aft vertical shim edges of the first and second lower portions. Vertical cutback edges of the cutbacks extend upwardly from the base through a portion of the first and second lower portions of the first and second walls, respectively, and longitudinal cutback edges of the cutbacks extend substantially longitudinally and downwardly towards the vertical cutback edges. Fillets are disposed between the longitudinal cutback edges and the vertical cutback edges.

A gas turbine engine blade assembly includes a gas turbine engine blade having a blade dovetail root and a root slot broached or otherwise formed in a bottom of the dovetail root. The dovetail shim portion with the dovetail shape substantially conforms to at least a portion of a cross-sectional dovetail shape of the dovetail root through the root slot. The base is disposed within the root slot.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
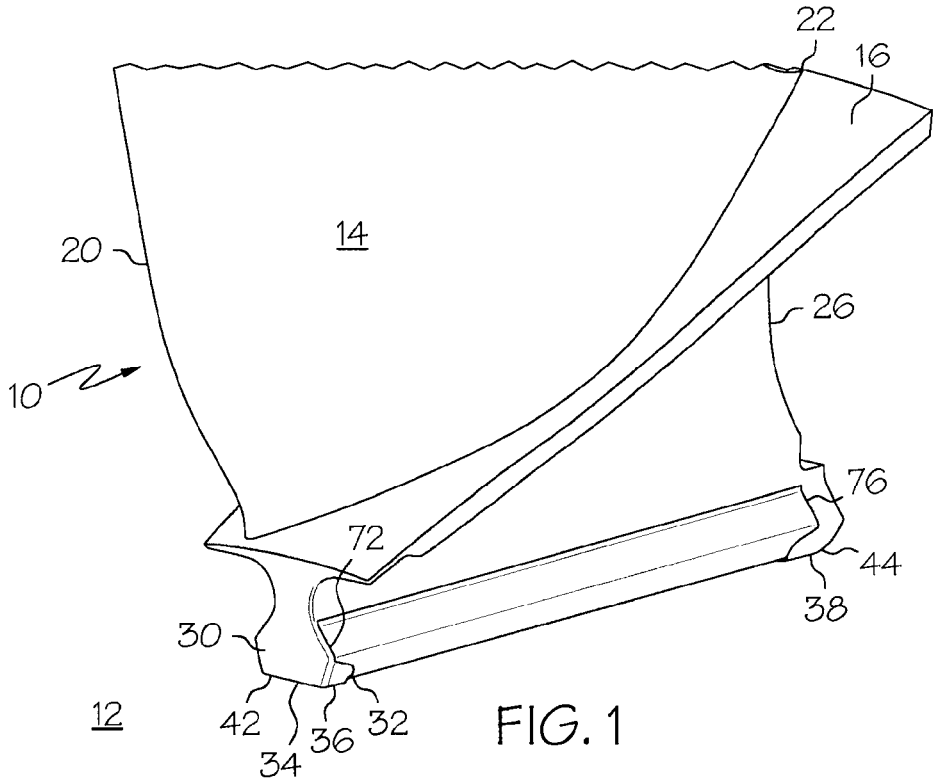
FIG. 1 is a perspective view illustration of a blade root with a shim slot and reduced bending resistant blade shim.

Illustrated in FIG. 1 is an exemplary gas turbine engine blade assembly 12 having a blade 10 illustrated as a fan blade. The blade 10 includes an airfoil 14 that extends radially outwardly from a blade platform 16 and axially from a blade leading edge 20 to a blade trailing edge 22. A blade shank 26 extends radially inwardly to a blade dovetail root 30 which is dovetail-shaped to be received by a dovetail-shaped disk slot in a gas turbine engine disk or rotor. A cross broach or root slot 32, having a radially inwardly facing slot surface 33, extends into a bottom 34 of the dovetail root 30 between radially inwardly extending leading and trailing edge tabs 36 and 38 at leading and trailing root edges 42 and 44.

Figure 2:
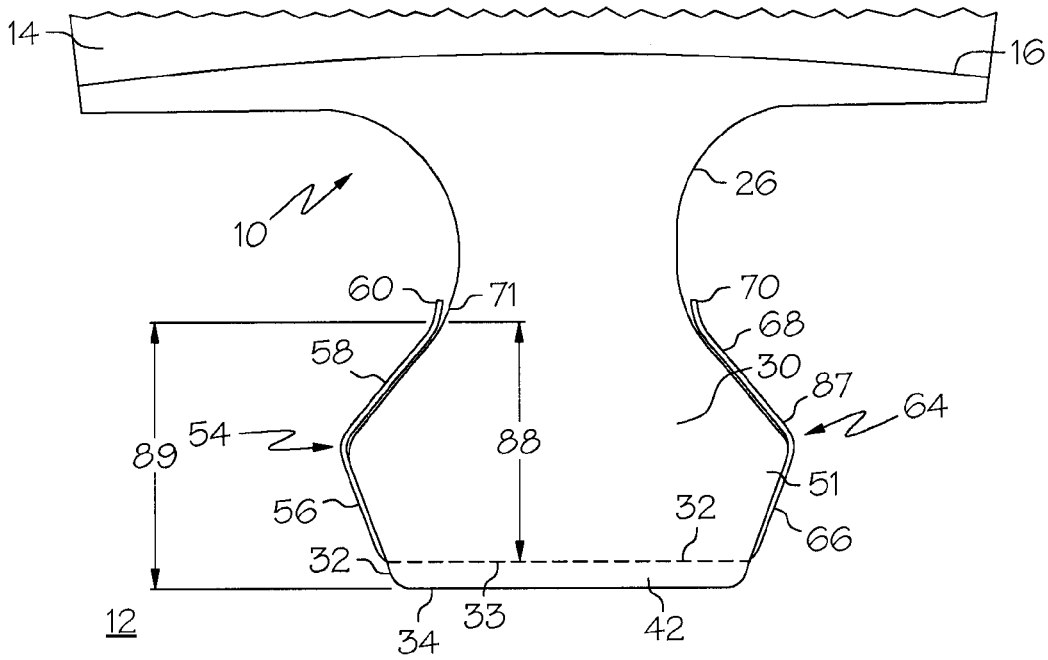
FIG. 2 is a front view illustration of the blade and shim illustrated in FIG. 1.
Figure 3:
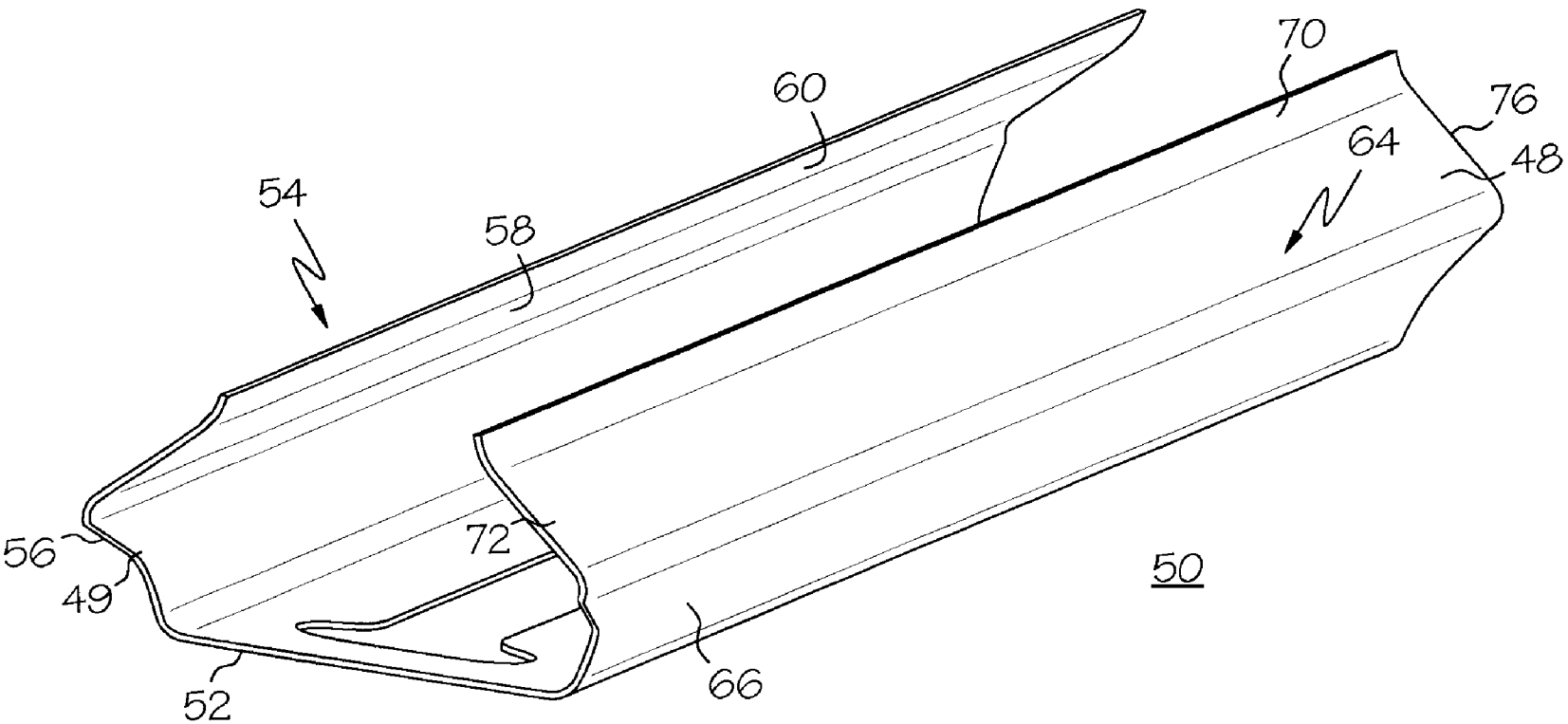
FIG. 3 is a perspective view illustration of the shim illustrated in FIG. 1.

Referring to FIGS. 1 and 2, a resilient root shim 50 is disposed in the root slot 32 and around the dovetail root 30 to which it generally conforms. The shim 50 generally conforms to a cross-sectional dovetail shape 51 of the dovetail root 30 through the root slot 32. Referring to FIGS. 3–6, the shim 50 has a longitudinally extending flat base 52 and transversely spaced apart first and second walls 54 and 64 that extend upwardly from the base 52. The first and second walls 54 and 64 have first and second lower portions 56 and 66 that extend at an angle away from the base 52 and from each other. The first and second walls 54 and 64 have a first and second upper portions 58 and 68 that extend towards each other and first and second end portions 60 and 70 that generally conforms to a transition portion 71 (illustrated in FIG. 2) of the blade between the blade shank 26 and the blade dovetail root 30. The shim 50 is made from thin resilient metal sheet and may have anti-friction or anti-fretting coatings on inner and/or outer sides 48 and 49 of the shim.

The shim 50 extends from a forward end 72 to a aft end 76. The leading edge tab 36 is received within a forward slot 74 formed in the forward end 72 of the base 52. The trailing edge tab 38 is received within an aft slot 78 formed in the aft end 76 of the base 52. Cutbacks 80 in the first and second lower portions 56 and 66 of the first and second walls 54 and 64, respectively, extend from the flat base 52 at the forward and aft slots 74 and 78 to forward and aft vertical shim edges 104 and 106 of the first and second lower portions 56 and 66. The cutbacks 80 include vertical cutback edges 82 extending upwardly from the base 52 through a portion, illustrated as about ½, of the first and second lower portions 56 and 66 of the first and second walls 54 and 64, respectively. Longitudinal cutback edges 84 extend substantially longitudinally and downwardly towards the vertical cutback edges 82. Fillets 86 are disposed between the longitudinal cutback edges 84 and the vertical cutback edges 82. This provides a smooth transition for the cutbacks 80 between the horizontal base 52 and vertical cutback edges of the first and second lower portions 56 and 66 of the first and second walls 54 and 64, respectively.

Referring to FIG. 2, the shim 50 has a dovetail shim portion 87 with a shim dovetail height 88 that is smaller than a blade root height 89 of the dovetail root 30 of the blade 10 to accommodate the root slot 32 and conform to the dovetail shape of the dovetail root. The dovetail shim portion 87 with the dovetail shape 51 substantially conforms to at least a portion of the cross-sectional dovetail shape 51 of the dovetail root 30 through the root slot 32. The base 52 is disposed within the root slot 32. As such, the shim 50 must be flexible enough to be spread apart so that it can fit over the larger dovetail blade root 30 yet not break or deform so as to lose its resiliency and its ability to conform and maintain its snap fit on the blade root.

Figure 4:
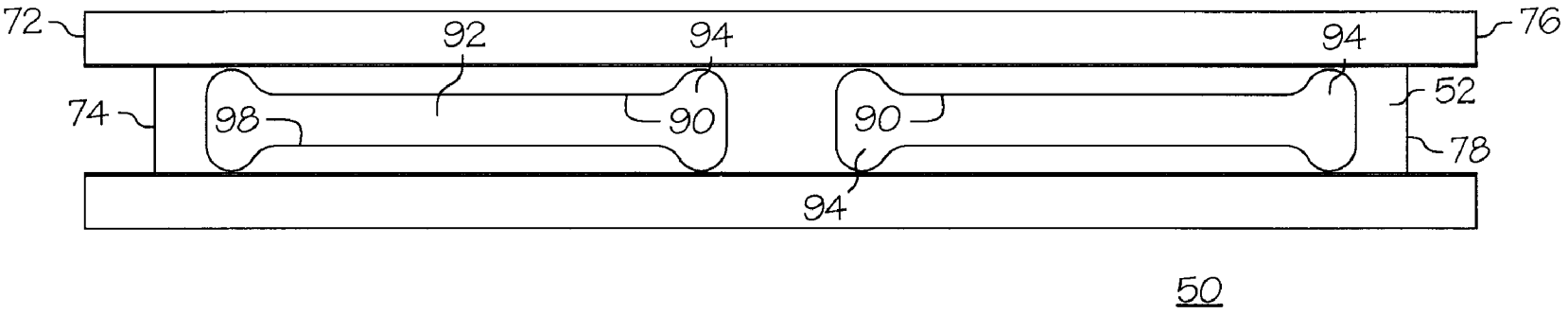
FIG. 4 is a top view illustration of the shim illustrated in FIG. 3.
Figure 5:
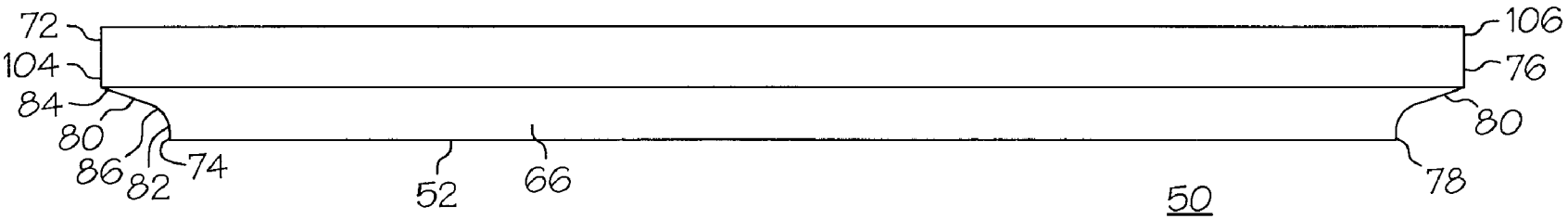
FIG. 5 is a side view illustration of the shim illustrated in FIG. 3.
Figure 6:
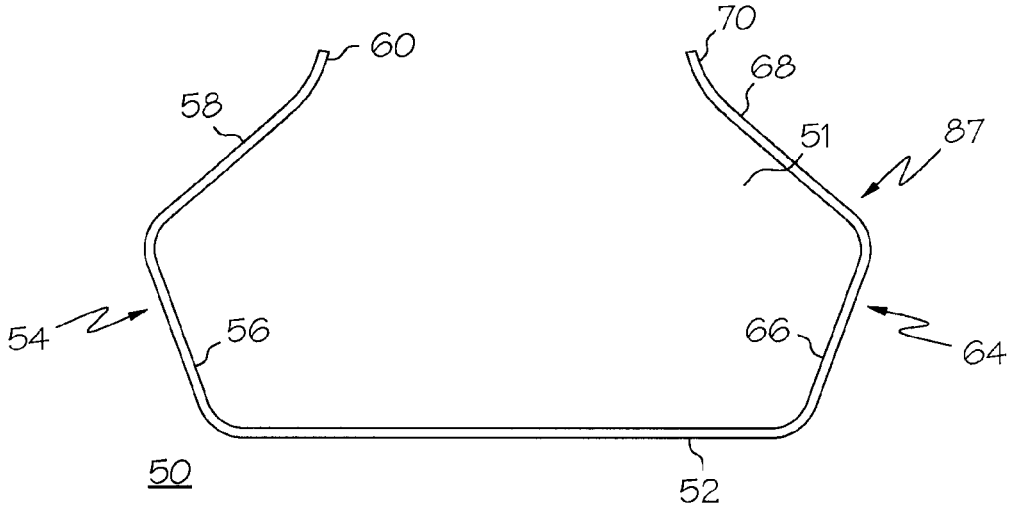
FIG. 6 is an enlarged front view illustration of the shim illustrated in FIG. 3.
Figure 7:
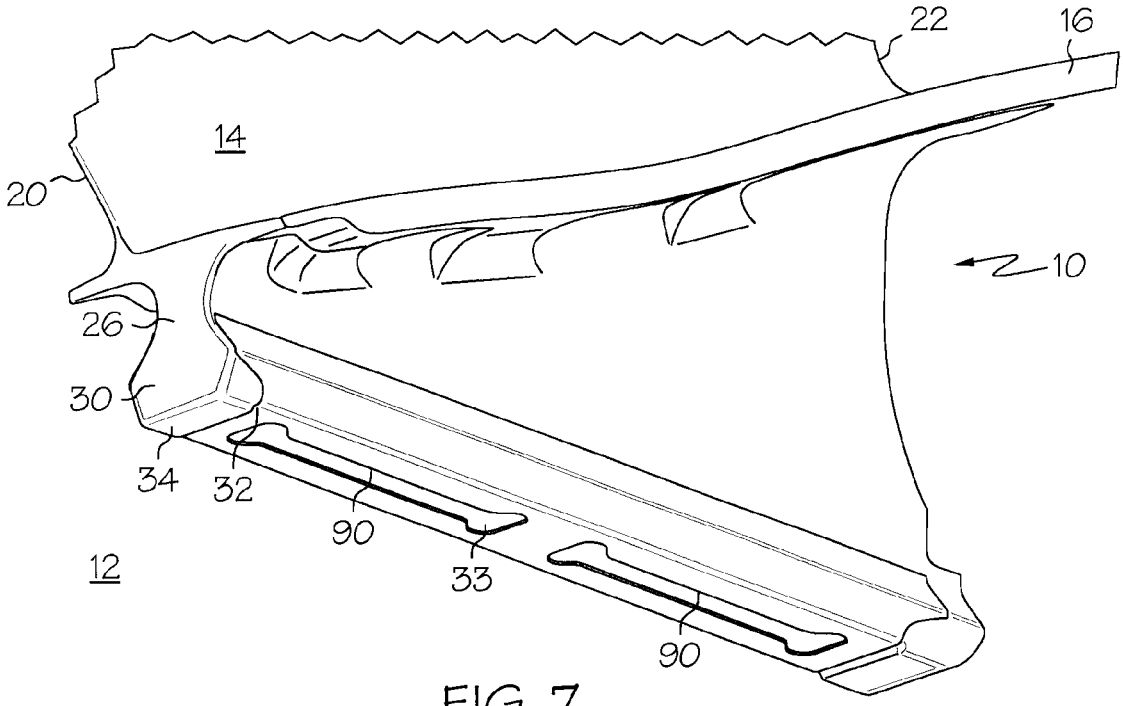
FIG. 7 is a radially outwardly and axially aftwardly looking perspective view illustration of the blade root and shim illustrated in FIG. 1.
Figure 8:
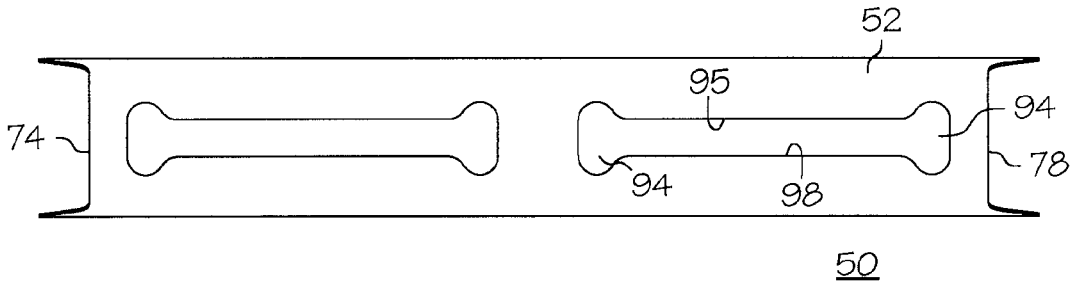
FIG. 8 is a radially outwardly looking view illustration of the shim illustrated in FIG. 7.
Figure 9:
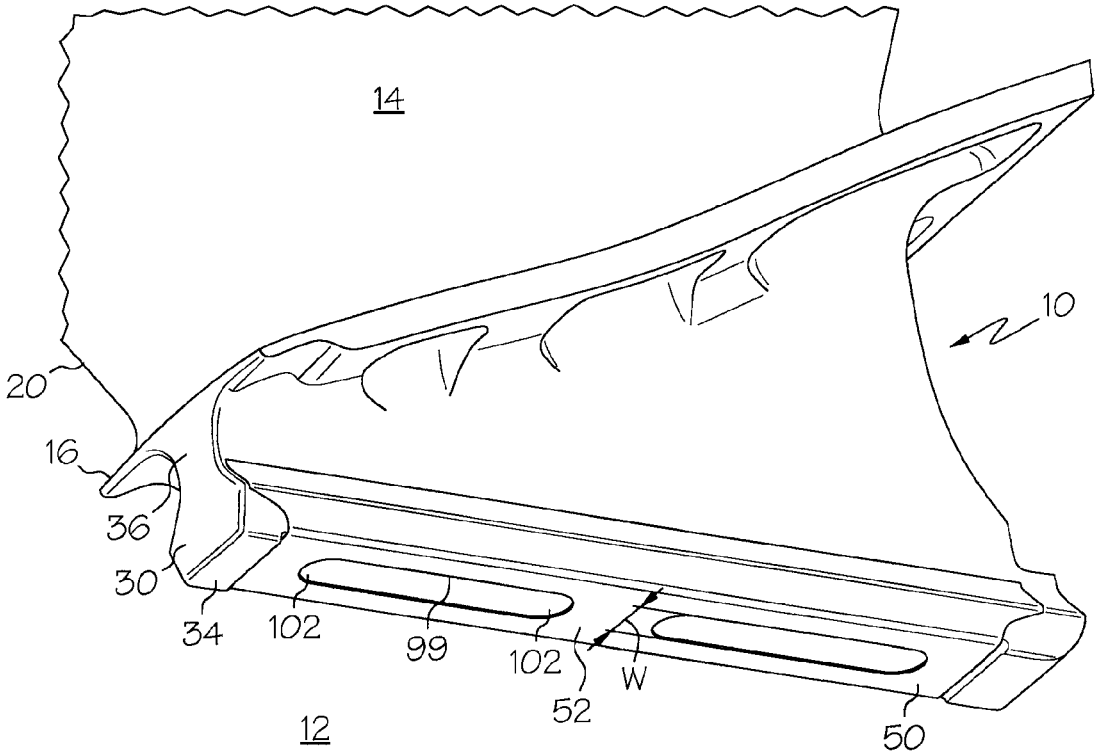
FIG. 9 is a radially outwardly and axially aftwardly looking perspective view illustration of the blade root with an alternative shim.

Two longitudinally extending elongated base apertures 90 in the base 52 provide flexibility to the base and shim 50. More than two elongated base apertures 90 may be used. Each of the base apertures 90 has a main region 92 and longitudinally spaced apart rounded end regions 94 as illustrated in FIGS. 4, 7, 8, and 9. Aperture sides 98 of the main region 92 are substantially parallel and straight. Illustrated in FIGS. 4, 7, 8 are two dog-bone-shaped base apertures 95 in which the rounded end regions 94 are wider than the main region 92. FIG. 9 illustrates two rounded end base apertures 99 with semi-circular rounded end regions 102 having a width W which is the same width as that of the main region 92.

The present invention has been described in an illustrative manner. It is to be understood that the terminology which has been used is intended to be in the nature of words of description rather than of limitation. While there have been described herein, what are considered to be preferred and exemplary embodiments of the present invention, other modifications of the invention shall be apparent to those skilled in the art from the teachings herein and, it is, therefore, desired to be secured in the appended claims all such modifications as fall within the true spirit and scope of the invention.

Accordingly, what is desired to be secured by Letters Patent of the United States is the invention as defined and differentiated in the following claims:

What is claimed is:

1. A gas turbine engine blade root shim comprising:

a dovetail shim portion with a dovetail shape, the dovetail shim portion including a longitudinally extending substantially flat base and distal first and second longitudinally spaced apart forward and aft ends, transversely spaced apart first and second walls extend upwardly from the base, at least two longitudinally extending elongated base apertures in the base, and each of the base apertures include a main region and longitudinally spaced apart rounded end regions.

2. A blade root shim as claimed in claim 1, further comprising the main region of the base apertures having substantially parallel and straight aperture sides.

3. A blade root shim as claimed in claim 2, wherein the base apertures are dog-bone-shaped base apertures and the rounded end regions are wider than the main region.

4. A blade root shim as claimed in claim 2, wherein the base apertures are rounded end base apertures and the rounded end regions are semi-circular rounded end regions having a width which is the same width as that of the main region.

5. A gas turbine engine blade assembly as claimed in claim 2, wherein the base apertures are rounded end base apertures and the rounded end regions are semi-circular rounded end regions having a width which is the same width as that of the main region.

6. A blade root shim as claimed in claim 1, further comprising:

the first and second walls having first and second lower portions extending upwardly from and at an angle away from the base and from each other, and first and second upper portions extending upwardly from the first and second lower portions respectively and towards each other.

7. A blade root shim as claimed in claim 6, further comprising the main region of the base apertures having substantially parallel and straight aperture sides.

8. A blade root shim as claimed in claim 7, wherein the base apertures are dog-bone-shaped base apertures and the rounded end regions are wider than the main region.

9. A blade root shim as claimed in claim 7, wherein the base apertures are rounded end base apertures and the rounded end regions are semi-circular rounded end regions having a width which is the same width as that of the main region.

10. A blade root shim as claimed in claim 6, further comprising forward and aft slots in the base at the forward and aft ends of the dovetail shim portion.

11. A blade root shim as claimed in claim 10, further comprising cutbacks in the first and second lower portions of the first and second walls respectively extending from the base at the forward and aft slots to forward and aft vertical shim edges of the first and second lower portions.

12. A blade root shim as claimed in claim 11, further comprising:

vertical cutback edges of the cutbacks extending upwardly from the base through a portion of the first and second lower portions of the first and second walls respectively, longitudinal cutback edges of the cutbacks extending substantially longitudinally and downwardly towards the vertical cutback edges, and fillets disposed between the longitudinal cutback edges and the vertical cutback edges.

13. A gas turbine engine blade assembly comprising:

a gas turbine engine blade having a blade dovetail root, a root slot having a radially inwardly facing slot surface extending into a bottom of the dovetail root, a root shim having a dovetail shim portion with a dovetail shape, the dovetail shim portion substantially conforming to at least a portion of a cross-sectional dovetail shape of the dovetail root through the root slot, the dovetail shim portion including a longitudinally extending substantially flat base and distal first and second longitudinally spaced apart forward and aft ends, transversely spaced apart first and second walls extend upwardly from the base, at least two longitudinally extending elongated base apertures in the base, and each of the base apertures include a main region and longitudinally spaced apart rounded end regions.

14. A gas turbine engine blade assembly as claimed in claim 13, further comprising the main region of the base apertures having substantially parallel and straight aperture sides.

15. A gas turbine engine blade assembly as claimed in claim 14, wherein the base apertures are dog-bone-shaped base apertures and the rounded end regions are wider than the main region.

16. A gas turbine engine blade assembly as claimed in claim 13, further comprising:

the first and second walls having first and second lower portions extending upwardly from and at an angle away from the base and from each other, and first and second upper portions extending upwardly from the first and second lower portions respectively and towards each other.

17. A gas turbine engine blade assembly as claimed in claim 16, further comprising the main region of the base apertures having substantially parallel and straight aperture sides.

18. A gas turbine engine blade assembly as claimed in claim 17, wherein the base apertures are dog-bone-shaped base apertures and the rounded end regions are wider than the main region.

19. A gas turbine engine blade assembly as claimed in claim 17, wherein the base apertures are rounded end base apertures and the rounded end regions are semi-circular rounded end regions having a width which is the same width as that of the main region.

20. A gas turbine engine blade assembly as claimed in claim 16, further comprising forward and aft slots formed in the forward and aft ends of the base.

21. A gas turbine engine blade assembly as claimed in claim 20, further comprising cutbacks in the first and second lower portions of the first and second walls respectively extending from the base at the forward and aft slots to forward and aft vertical shim edges of the first and second lower portions.

22. A gas turbine engine blade assembly as claimed in claim 21, further comprising:

vertical cutback edges of the cutbacks extending upwardly from the base through a portion of the first and second lower portions of the first and second walls respectively, longitudinal cutback edges of the cutbacks extending substantially longitudinally and downwardly towards the vertical cutback edges, and fillets disposed between the longitudinal cutback edges and the vertical cutback edges.

* * * * *